US005754160A

United States Patent [19]

Shimizu et al.

[11] Patent Number: 5,754,160

[45] Date of Patent: May 19, 1998

[54] LIQUID CRYSTAL DISPLAY DEVICE HAVING A PLURALITY OF SCANNING METHODS

[75] Inventors: Masayuki Shimizu; Hiroaki Usami, both of Hamura, Japan

[73] Assignee: Casio Computer Co., Ltd., Tokyo, Japan

[21] Appl. No.: 420,411

[22] Filed: Apr. 12, 1995

[30] Foreign Application Priority Data

Apr. 18, 1994 [JP] Japan ..... 6-104823

[51] Int. Cl.[6] ..... G09G 3/36

[52] U.S. Cl. ..... 345/103; 345/204; 345/132; 345/94; 345/208; 348/589; 348/790

[58] Field of Search ..... 348/446, 447, 348/443, 448, 790–792, 793, 714, 718–719, 589, 600; 395/152; 345/132, 87, 94, 95, 96, 103, 204, 208, 209, 210, 122, 115, 116, 119; H04N 9/74, 7/01, 3/14, 9/30, 9/64

[56] References Cited

U.S. PATENT DOCUMENTS

| | | | |
|---|---|---|---|
| 4,694,348 | 9/1987 | Kamiya et al. | 348/793 |
| 5,018,076 | 5/1991 | Johary et al. | 345/87 |
| 5,049,865 | 9/1991 | Nakamura et al. | 345/204 |
| 5,089,812 | 2/1992 | Fuse et al. | 345/89 |
| 5,091,784 | 2/1992 | Someya et al. | 345/87 |
| 5,206,634 | 4/1993 | Matsumoto et al. | 345/99 |

FOREIGN PATENT DOCUMENTS

| | | |
|---|---|---|
| 62-175075 | 7/1987 | Japan . |
| 3-19557 | 3/1991 | Japan . |

*Primary Examiner*—Richard Hjerpe
*Assistant Examiner*—Lun-Yi Lao
*Attorney, Agent, or Firm*—Frishauf, Holtz, Goodman, Langer & Chick

[57] ABSTRACT

The present invention relates to a liquid crystal display device in which a liquid crystal display panel is divided into a plurality of areas and the number of common lines scanned at once is changed for each of the areas. More specifically, the liquid crystal display panel is divided into a 2α drive area and a 1α drive area. Based on a CDB signal, a scanning circuit selects and scans two common lines at once in the 2α drive area and shifts the selected two lines one by one. The scanning circuit selects and scans one common line in the 1α drive area and shifts the selected line one by one.

18 Claims, 13 Drawing Sheets

| DISPLAY AREA | SCANNING LINES | | FRAME | |
|---|---|---|---|---|
| | | | FIRST FIELD | SECOND FIELD |
| FIRST DISPLAY AREA | 1 ~ 200 | ODD LINES | 1α DRIVE | 2α DRIVE |
| | | EVEN LINES | 2α DRIVE | 1α DRIVE |
| SECOND DISPLAY AREA | 201 ~ 220 | ODD LINES | 1α DRIVE | 1α DRIVE |
| | | EVEN LINES | | |

FIG.8

| DISPLAY AREA | SCANNING LINES | | FRAME | |
|---|---|---|---|---|
| | | | FIRST FIELD | SECOND FIELD |
| FIRST DISPLAY AREA | 1 ~ 200 | ODD LINES | 3α DRIVE | 3α DRIVE |
| | | EVEN LINES | | |
| SECOND DISPLAY AREA | 201 ~ 220 | ODD LINES | 1α DRIVE | 2α DRIVE |
| | | EVEN LINES | 2α DRIVE | 1α DRIVE |

FIG.10

| DRIVE CODE | SCAN DRIVE METHOD OF FIRST DISPLAY AREA | SCAN DRIVE METHOD OF SECOND DISPLAY AREA |
|---|---|---|
| 01 | 1α DRIVE | 1α DRIVE |
| 02 | 2α DRIVE | 2α DRIVE |
| 03 | 2α DRIVE | 1α DRIVE |
| 04 | 1α DRIVE | 2α DRIVE |

FIG.13

LIQUID CRYSTAL DISPLAY DEVICE HAVING A PLURALITY OF SCANNING METHODS

BACKGROUND OF THE INVENTION

1. Field of the Invention

The present invention relates to a liquid crystal display device in which scanning lines are divided into a plurality of groups and each of the groups is driven based on a different scanning method.

2. Description of the Related Art

Conventionally a liquid crystal display device, which is applied to a liquid crystal television receiver and the like, includes an LCD panel driven by both a scan driver and a segment driver. These drivers are supplied with a driving voltage from a power supply, and are also supplied with a display control signal and display data from a controller.

Unlike a television receiver having a commonly-used CRT (Cathode Ray Tube), the liquid crystal display device does not distinguish first (or odd) and second (or even) fields constituting one frame from each other. Data of the first and second fields are displayed by scanning the same scanning lines of the LCD panel.

If an LCD panel has a number of scanning lines, the period of a scan drive signal for every scanning line is lengthened. Therefore, the effective voltage applied to liquid crystal per unit of time is dropped, resulting in degradation in contrast.

To improve the contrast, plural, e.g., two or three scanning lines are driven at once to shorten the scanning period and enhance the effective voltage applied to the liquid crystal.

When the number of effective scanning lines of the liquid crystal display device is 220, if a CDB signal, which determines the scanning start timing and width of a scanning line, indicates that three scanning lines are simultaneously scanned, that two scanning lines are simultaneously scanned, and that a single scanning line is scanned, the duty ratios are 1/73.3, 1/110, and 1/220 respectively. The larger the number of scanning lines to be driven simultaneously, the more the contrast can be improved.

If the scanning lines are scanned one by one, the LCD response is slow and the contrast is low. However, the outlines of characters and symbols are clearly displayed.

If two or three scanning lines are scanned at the same time, the LCD response is quickened and the contrast is improved, whereas the outlines of characters and symbols are blurred, thereby decreasing image quality.

The foregoing conventional liquid crystal display device has the drawback wherein, since two or three scanning lines are driven at once, the scan drive signals of the LCD panel are supplied at time intervals of one horizontal scan (1H) or two horizontal scans (2H) in a partially overlapped manner and, therefore, subtitles of foreign films, characters of video game software or the like are blurred, unclear, and difficult to read.

SUMMARY OF THE INVENTION

Accordingly, it is an object of the present invention to provide a liquid crystal display device capable of displaying an image with a quick response and a sharp contrast in a display area for displaying an animation image and for displaying a clear image free of blur in a display area for displaying a character or symbol image. The present invention achieves this object by selecting a scanning line driving method for each display area in accordance with the image density of a liquid crystal display panel.

According to the present invention, there is provided a liquid crystal display device for displaying an image of one frame formed of a first field and a second field, comprising a liquid crystal display panel including a plurality of scanning lines and a plurality of segment lines formed in matrix, and having a first display area and a second display area; display data supply means for supplying a segment drive signal corresponding to display data to the segment lines of the liquid crystal display panel; first scanning means for supplying a first scanning signal for simultaneously scanning at least two scanning lines during one scanning line period to the first display area; and second scanning means for supplying a second scanning signal for scanning at least one scanning line during one scanning line period to the second display area, the second scanning signal having a selection period other than a selection period of the first scanning signal output from the first scanning means.

According to the present invention, there is provided another liquid crystal display device for displaying an image of one frame formed of a first field and a second field, comprising a liquid crystal display panel including a plurality of scanning lines and a plurality of segment lines formed in matrix, and having a first display area and a second display area; display data supply means for supplying a segment drive signal corresponding to display data to the segment lines of the liquid crystal display panel; selection means for selecting one of a first scanning signal and a second scanning signal, the first scanning signal having a selection period of at least two scanning lines for one scanning line and the second scanning signal having a selection period of at least one scanning line other than the selection period of the first scanning signal for one scanning line; first scanning means for supplying one of the first scanning signal and the second scanning signal selected by the selection means to the first display area; and second scanning means for supplying one of the first scanning signal and the second scanning signal selected by the selection means to the second display area.

According to the present invention, there is provided a further liquid crystal display device comprising a liquid crystal display panel including a plurality of scanning lines and a plurality of segment lines formed in matrix, and having a first display area and a second display area; scanning means for supplying a scanning signal to the scanning lines of the liquid crystal display panel; and display data supply means for supplying a segment drive signal corresponding to display data to the segment lines of the liquid crystal display panel, whereby driving the first display area and the second display area by different driving methods.

According to the present invention, there is provided a still another liquid crystal display device comprising a liquid crystal display panel including a plurality of scanning lines and a plurality of segment lines formed in matrix, and having a first display area and a second display area; display data supply means for supplying a segment drive signal corresponding to display data to the segment lines of the liquid crystal display panel; selection means for selecting different driving methods for driving the first display area and the second display area, and for selecting the number of scanning lines of each of the first display area and the second display area; first scanning means for supplying a scanning signal based on the driving method selected by the selection means to the first display area; and second scanning means for supplying the scanning signal based on the driving method selected by the selection means to the second display area.

According to the present invention, there is provided a still further liquid crystal display device comprising a liquid crystal display panel including a plurality of scanning lines and a plurality of segment lines formed in matrix, and having a first display area and a second display area; scanning means for supplying a scanning signal to the scanning lines of the liquid crystal display panel; and display data supply means for supplying a segment drive signal corresponding to display data to the segment lines of the liquid crystal display panel, wherein the first display area includes a display area for displaying an animation image and the second display area includes a display area for displaying a still image.

Additional objects and advantages of the present invention will be set forth in the description which follows, and in part will be obvious from the description, or may be learned by practice of the present invention. The objects and advantages of the present invention may be realized and obtained by circuit of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 8 shows scan drive methods of the liquid crystal display device according to the second embodiment of the present invention;

FIG. 10 shows scan drive methods of the liquid crystal display device according to the third embodiment of the present invention;

FIG. 13 shows a selection of a scanning method of the liquid crystal display device according to the fourth embodiment of the present invention.

DETAILED DESCRIPTION OF THE PREFERRED EMBODIMENTS

A preferred embodiment of a liquid crystal display device according to the present invention will now be described with reference to the accompanying drawings.

(First Embodiment)

Figure 1:
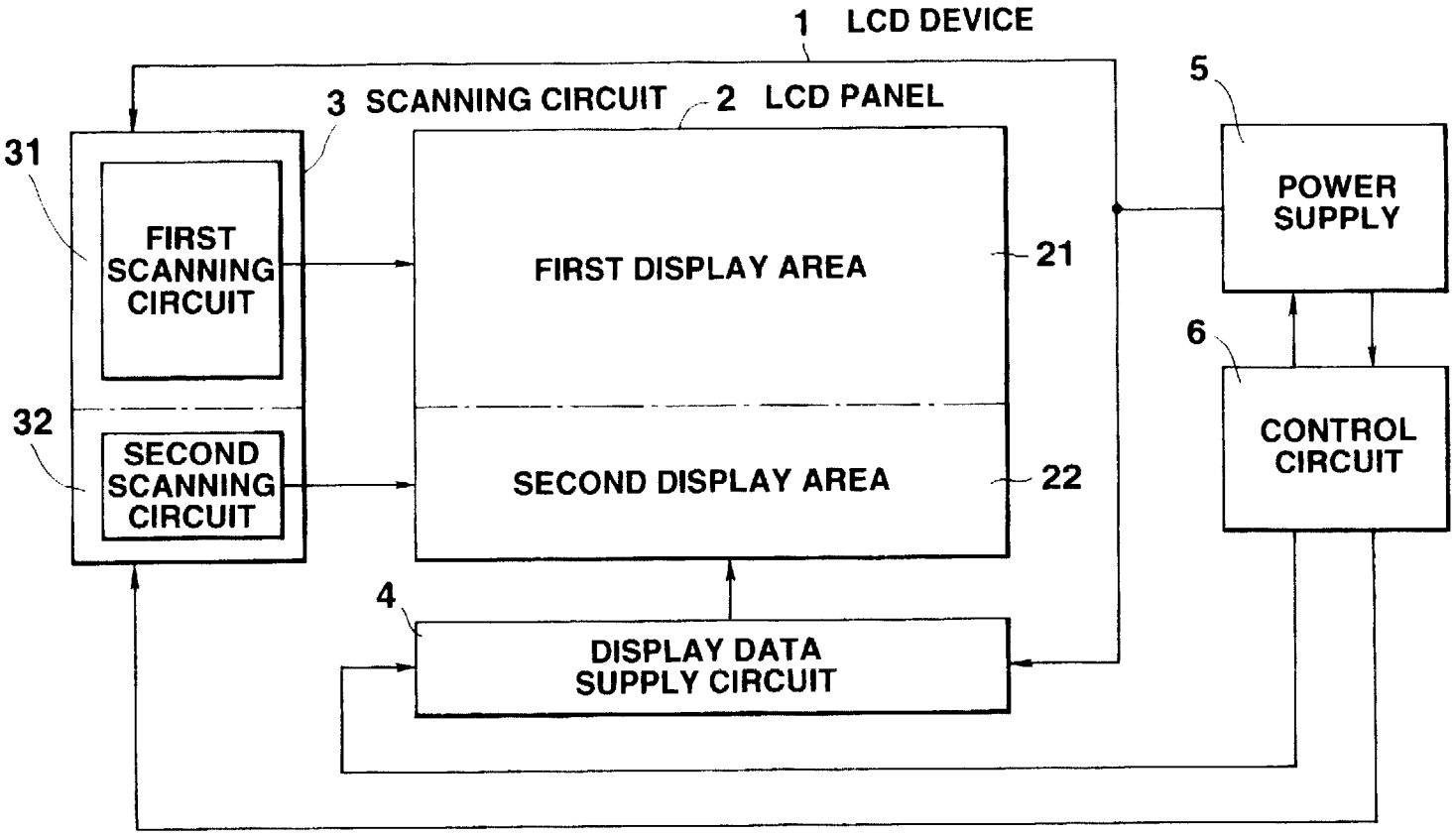
FIG. 1 is a block diagram showing a circuit arrangement of a liquid crystal display device according to a first embodiment of the present invention.

FIG. 1 is a block diagram showing a circuit arrangement of the liquid crystal display (LCD) device according to the first embodiment.

As shown in FIG. 1, an LCD device 1 for displaying an image, e.g., a television image, comprises an LCD panel 2, a scanning circuit 3, a display data supply circuit 4, a power supply 5, and a control circuit 6.

The LCD panel 2 comprises a pair of transparent glass substrates between which liquid crystal is interposed. A plurality of segment lines and scanning lines are formed in matrix on the opposing surfaces of these substrates.

The LCD panel 2 includes a first display area 21 and a second display area 22.

The scanning circuit 3 includes a first scanning circuit 31 and a second scanning circuit 32.

The display data supply circuit 4 supplies display data to the LCD panel 2.

Figure 2:
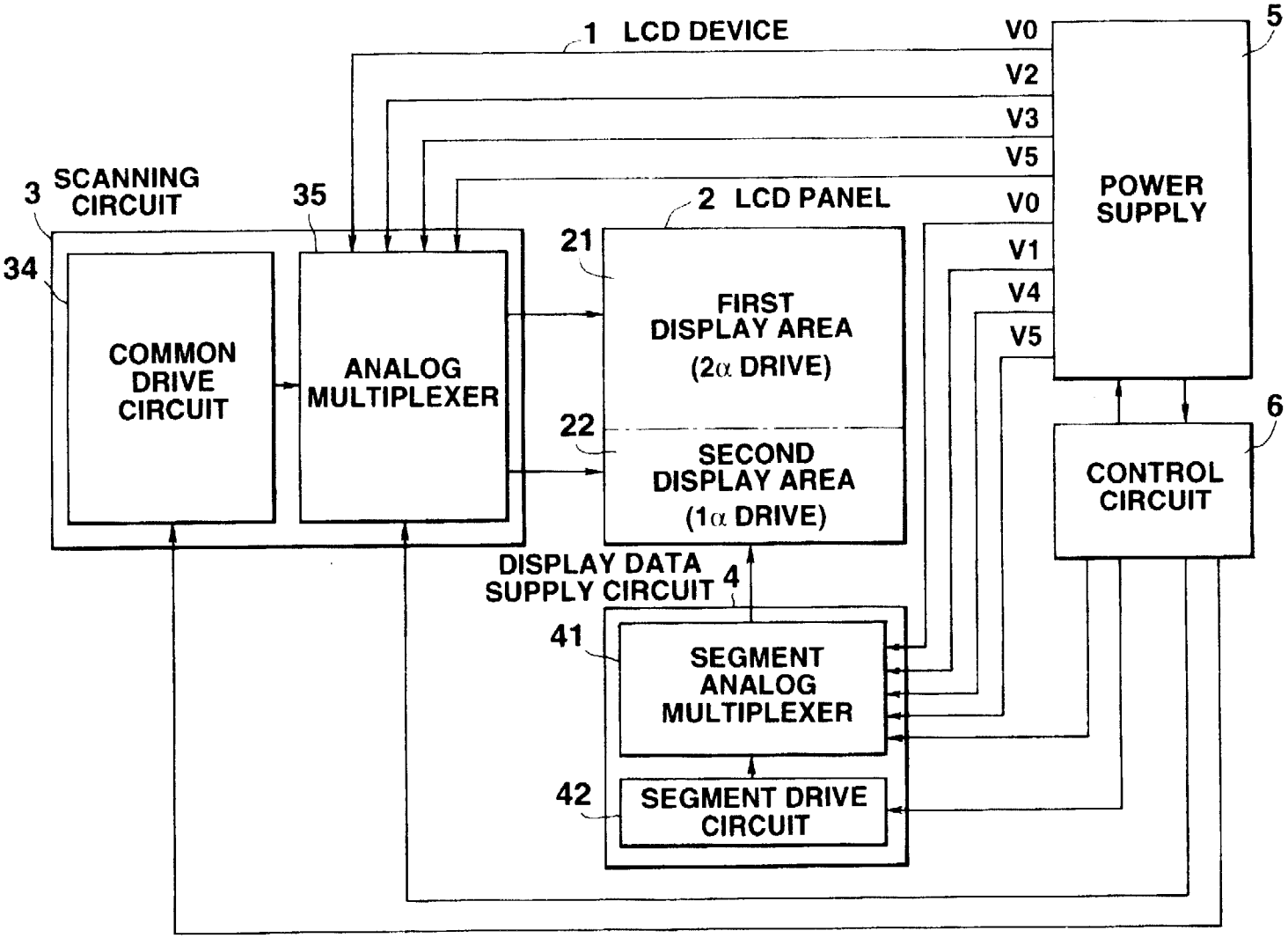
FIG. 2 is a block diagram showing in detail the circuit arrangement of the liquid crystal display device of FIG. 1.

As shown in FIG. 2, the power supply 5 supplies scan drive voltages V0, V2, V3 and V5 to the scanning circuit 3, segment drive voltages V0, V1, V4 and V5 to the display data supply circuit 4, and logic voltages V0 and V5 to the control circuit 6.

The control circuit 6 supplies display control signals to the scanning circuit 3 and display data supply circuit 4, and supplies display data to the display data supply circuit 4. The control circuit 6 also supplies the power supply 5 with a DISP signal for indicating the supply of power to the scanning circuit 3 and display data supply circuit 4 when power is on.

While the first scanning circuit 31 scans the first display area 21, the second scanning circuit 32 does the second display area 22.

FIG. 2 is a block diagram showing in detail the circuit arrangement of the liquid crystal display device of FIG. 1.

The scanning circuit 3 includes a common-side drive circuit 34 and a common-side analog multiplexer 35, and receives a display control signal from the control circuit 6, as will be described later.

The display data supply circuit 4 has a segment-side drive circuit 42 and a segment-side analog multiplexer 41, and receives display data and a display control signal from the control circuit 6, as will be described later.

The scanning lines of the LCD panel 2 are connected to the output terminals of the common-side analog multiplexer 35, and the segment lines thereof are connected to the output terminals of the segment-side analog multiplexer 41.

Figure 3:
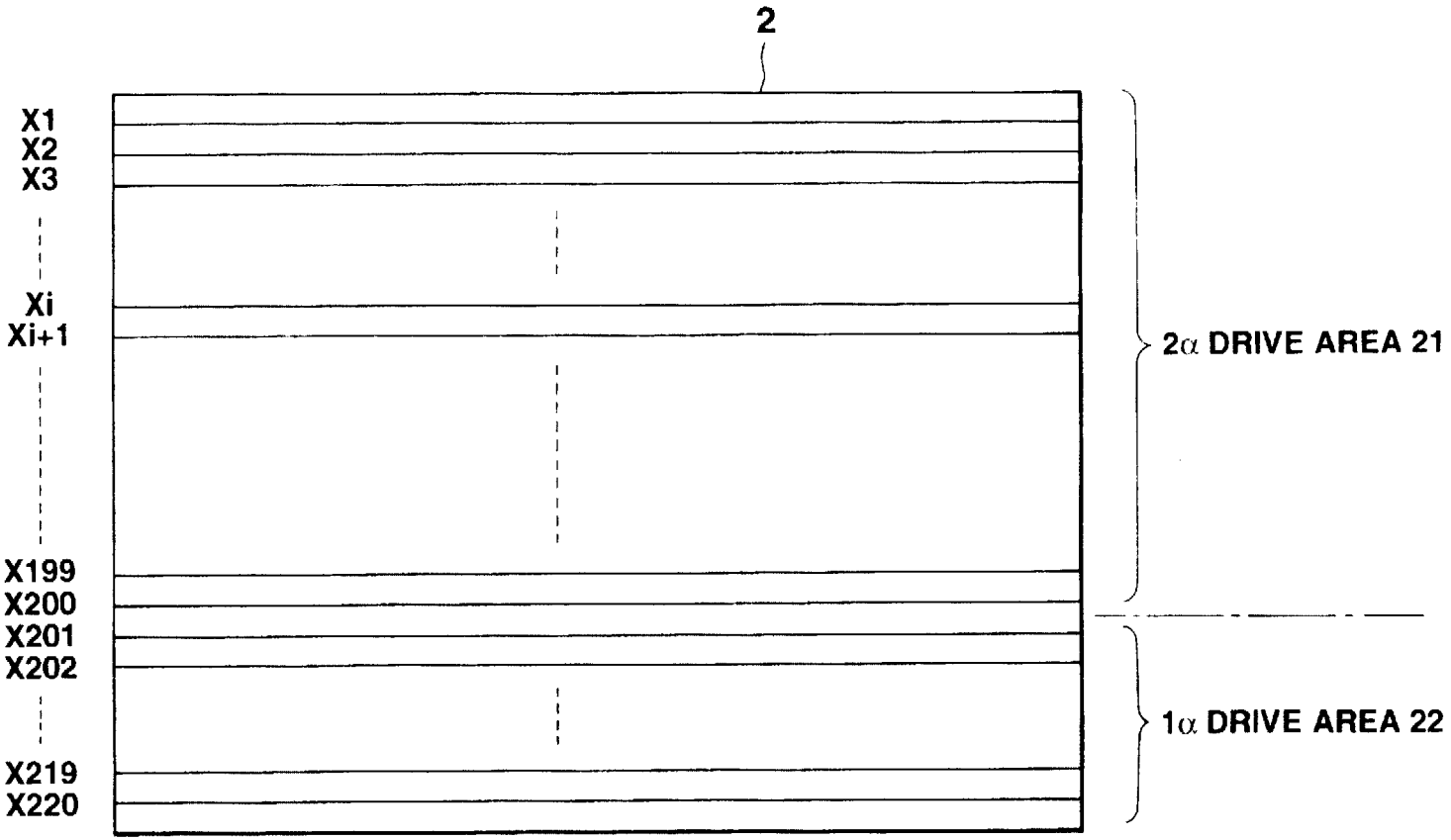
FIG. 3 is a view showing display areas of an LCD panel of the liquid crystal display device of FIG. 1, the areas being illustrated by corresponding scanning lines.

As shown in FIG. 3, the LCD panel 2 has 220 scanning lines. The first display area (hereinafter referred to as a 2α drive area) 21 includes first to two hundredth scanning lines X1 to X200, and the second display area (hereinafter referred to as a 1α drive area) 22 does two hundred and first to two hundred and twentieth scanning lines X201 to X220. The common-side drive circuit 34 drives these drive areas 21 and 22 by different drive methods.

More specifically, in the 2α drive area 21, two scanning lines are selected and driven simultaneously, and the scanning lines are shifted one by one and, in the 1α drive area 22, only one scanning line is selected and driven, and the scanning lines are shifted one by one.

The power supply 5 generates a plurality of drive voltages V0 to V5 in accordance with the externally supplied power supply voltage, and supplies the voltages V0, V1, V4 and V5 to the segment-side analog multiplexer 41 and does the voltages V0, V2, V3 and V5 to the common-side analog multiplexer 35.

The control circuit 6 generates various display control signals based on the received video signal and supplies them to the scanning circuit 3 and display data supply circuit 4. The control circuit 6 also extracts display data from the received video signal and supplies it to the segment-side drive circuit 42.

The segment-side drive circuit 42 sequentially receives digital display data of plural bits, e.g., 3 bits from the control circuit 6. After the circuit 42 reads in display data of one line, it generates a gradation signal corresponding to the display data and supplies it to the segment-side analog multiplexer 41.

The segment-side analog multiplexer 41 selects one of drive voltages V0, V1 and V4 supplied from the power supply 5, in response to the gradation signal supplied from the segment-side drive circuit 42, and sequentially supplies it to each of the segment lines of the LCD panel 2.

The common-side drive circuit 34 receives the display control signals from the control circuit 6, and generates common drive timing signals according to the received display control signals. The common drive timing signals are supplied to the common-side analog multiplexer 35.

The display control signals supplied from the control circuit 6 to the common-side drive circuit 34 include a CFB signal, CNB signal, CDB signal, etc.

The CFB signal is a liquid crystal alternating inverting signal for inverting a drive signal for every scanning line, and the CNB signal is a transfer signal for sequentially shifting the CDB signal in the scanning circuit 3. The CDB signal is a signal for determining the scanning start timing of a scanning line and the selective width thereof.

The control circuit 6 outputs two CDB signals, i.e., CDB1 and CDB2 signals. The CDB1 signal selects two of the scanning lines X1 to X200 and drives them at the same time, while the CDB2 signal selects and drives one of the scanning lines X201 to X220.

Figure 4:
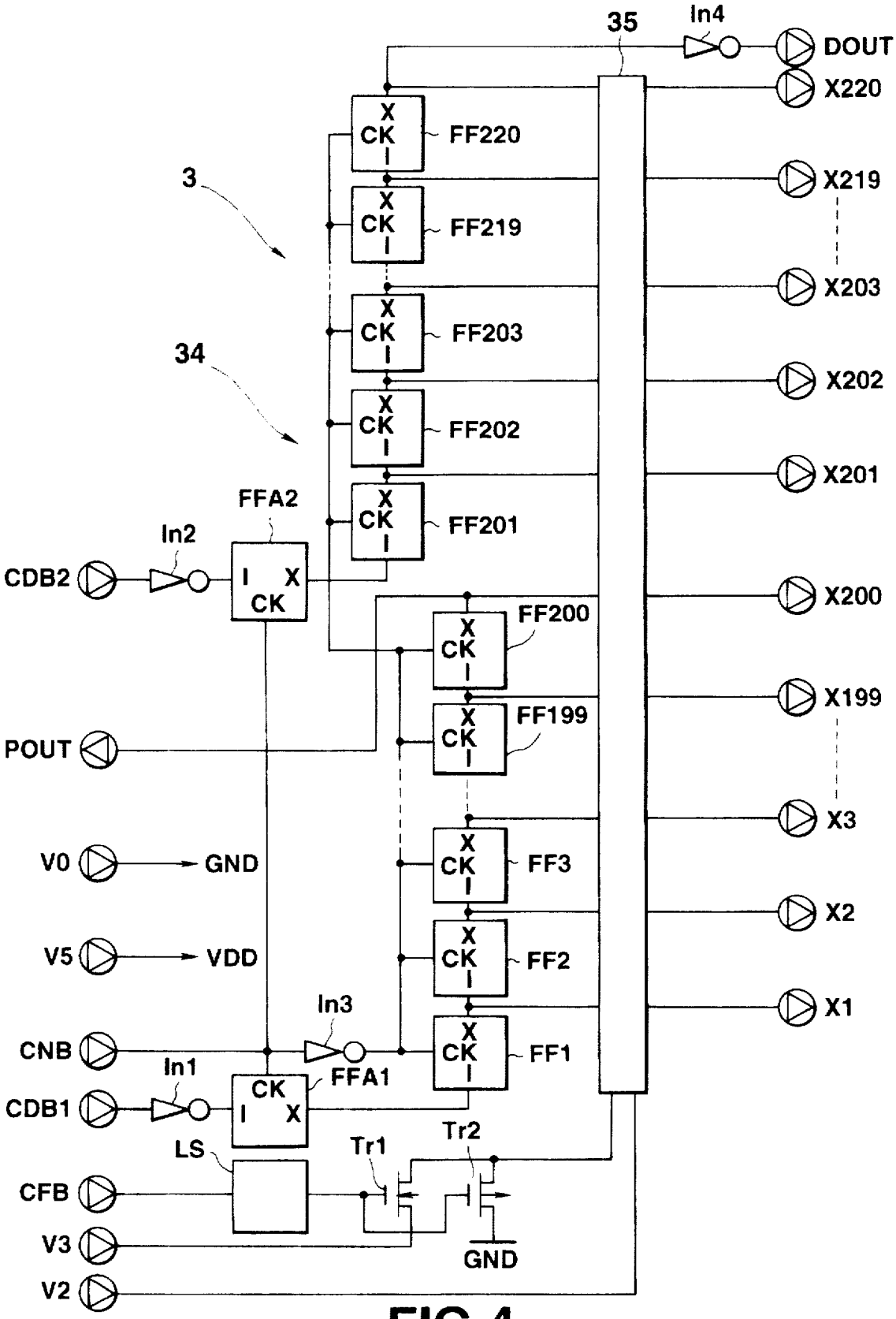
FIG. 4 is a view showing in detail a scan drive circuit of a scanning circuit shown in FIG. 2.

As illustrated in FIG. 4, the scanning circuit 3 comprises the common-side drive circuit 34 and common-side analog multiplexer 35, and the circuit 34 includes flip-flops FF1 to FF200 for supplying the common drive signals to the scanning lines X1 to X200, flip-flops FF201 to FF220 for supplying the common drive signals to the scanning lines X201 to X220, a flip-flop FFA1 for supplying the CDB1 signal to the flip-flop FF1, a flip-flop FFA2 for supplying the CDB2 signal to the flip-flop FF201, a level shifter LS, an N-channel transistor Tr1, a P-channel transistor Tr2, four inverters In1, In2, In3 and In4. The scanning circuit 3 also comprises input terminals for the display control signals (CNB, CFB, CDB1 and CDB2 signals) supplied from the control circuit 6, input terminals for the drive voltages V0, V2, V3 and V5 supplied from the power supply 5, a POUT terminal, output terminals X1 to X220 for the common drive signals connected to the scanning lines of the LCD panel 2, and a DOUT terminal.

The drive voltages V0, V2 and V3 are used to drive the LCD panel 2, in other words, they serve as common drive signals. The drive voltage V5 are used as logic voltages of the common-side drive circuit 34 and common-side analog multiplexer 35.

The flip-flop FFA1 has an input terminal I supplied with the CDB1 signal via the inverter In1 and an output terminal X connected to an input terminal I of the flip-flop FF1.

The flip-flop FFA1 also has a clock terminal CK supplied with the CNB signal from the control circuit 6. When the CNB signal is input to the clock terminal CK, the flip-flop FFA1 fetches the CDB1 signal supplied to the input terminal I and transmits it to the flip-flop FF1.

The flip-flop FFA2 has an input terminal I supplied with the CDB2 signal via the inverter In2 and an output terminal X connected to an input terminal I of the flip-flop FF201.

The flip-flop FFA2 also has a clock terminal CK supplied with the CNB signal from the control circuit 6. When the CNB signal is input to the clock terminal CK, the flip-flop FFA2 fetches the CDB2 signal from the input terminal I and transmits it to the flip-flop FF201.

The input terminals I of the flip-flops FF2 to FF199 are connected to their respective output terminals X of the preceding flip-flops FF1 to FF198. The output terminals X of the flip-flops FF2 to FF199 are connected to their respective input terminals I of the succeeding flip-flops FF3 to FF200 and to the input terminal of the common-side analog multiplexer 35.

As described above, the input terminal I of the flip-flop FF1 is connected to the output terminal X of the flip-flop FFA1, and the output terminal X thereof is connected to the input terminal I of the succeeding flip-flop FF2 and to the common-side analog multiplexer 35.

The output terminal X of the flop-flop FF200 is connected to the POUT terminal of the common-side drive circuit 34 and to the common-side analog multiplexer 35.

The clock terminals CK of the flip-flops FF1 to FF200 are supplied with the CNB signal through the inverter In3.

The input terminals I of the flip-flops FF202 to FF219 are connected to the output terminals X of the preceding flip-flops FF201 to FF218, and the output terminals X thereof are connected to the input terminals I of the succeeding flip-flops FF203 to FF220 and to the input terminal of the common-side analog multiplexer 35.

As described above, the input terminal I of the flip-flop FF201 is connected to the output terminal X of the flip-flop FFA2, and the output terminal X thereof is connected to the input terminal I of the succeeding flip-flop FF202 and to the common-side analog multiplexer 35.

The output terminal X of the flip-flop FF220 is connected to the DOUT terminal of the scanning circuit 3 through the inverter In4 and to the common-side analog multiplexer 35. The clock terminals CK of the flip-flops FF201 to FF220 are supplied with the CNB signal via the inverter In3.

Figure 5:
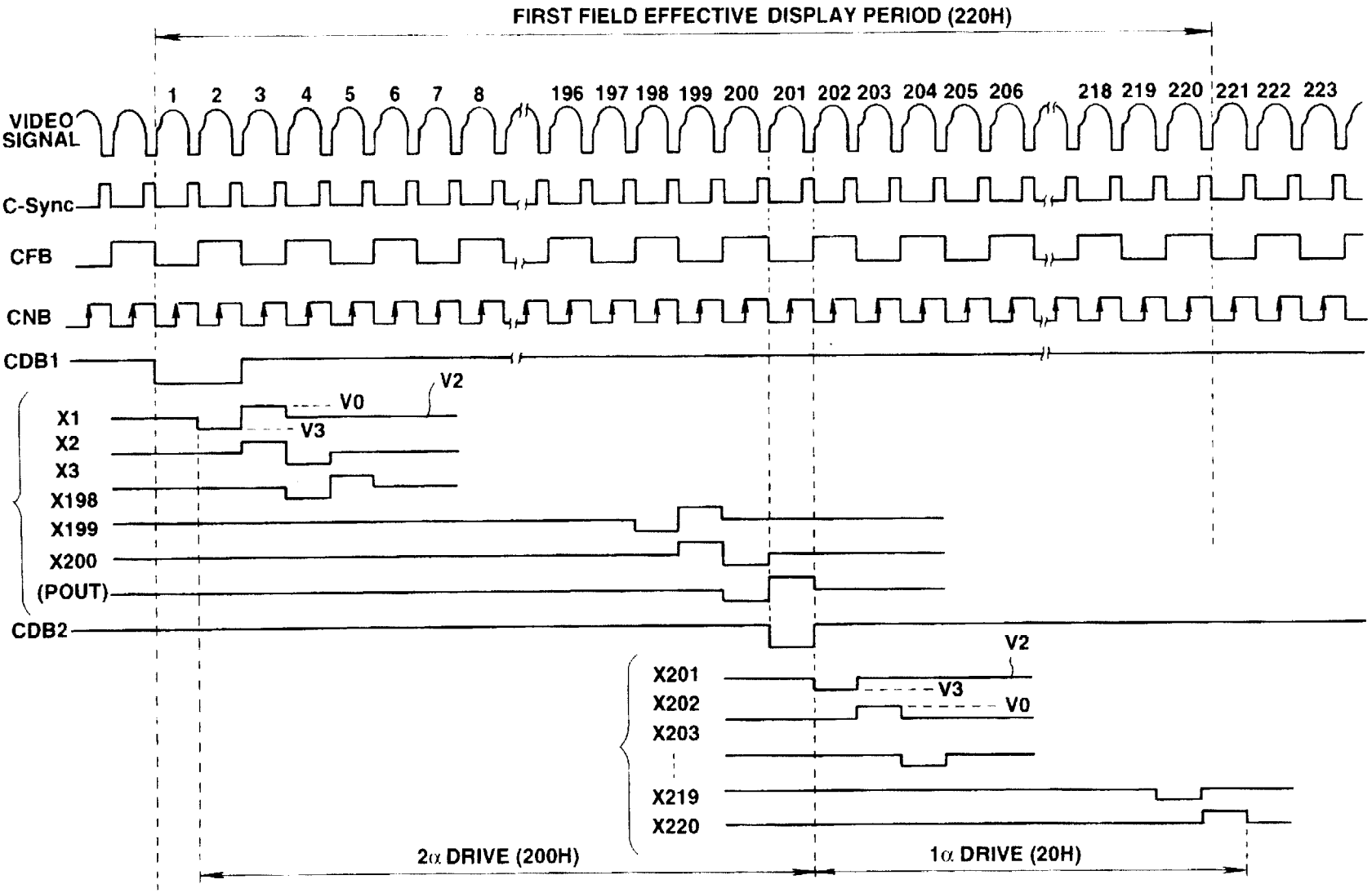
FIG. 5 is a timing chart of the liquid crystal display device according to the first embodiment of the present invention.

As shown in FIG. 5, the CDB1 signal is used to simultaneously select and drive the scanning lines X1 to X200 two by two. Each of the flip-flops FF1 to FF200 reads the CDB1 signal at the rise of the CFB signal and shifts it one by one. The shifted signal is then output from the output terminals X of the flip-flops FF1 to FF200.

Similarly, as shown in FIG. 5, the CDB2 signal is used to select and drive the scanning lines X201 to X220 one by one. Each of the flip-flops FF201 to F220 reads the CDB2 signal at the rise of the CFB signal and shifts it one by one. The shifted signal is supplied from the output terminals X of the flip-flops FF201 to FF220 to the common-side analog multiplexer 35 as a common drive timing signal.

When the N-channel transistor Tr1 is supplied with the CFB signal from its gate through the level shifter LS, it is turned on/off in response to the high/low level of the CFB signal thereby to supply/cut off the drive voltage V3 to the common-side analog multiplexer 35.

When the P-channel transistor Tr2 is supplied with the CFB signal from its gate through the level shifter LS, it is turned on/off in response to the high/low level of the CFB signal thereby to supply/cut off the drive voltage V0 to the common-side analog multiplexer 35.

It is thus apparent from FIG. 5 that the common-side analog multiplexer 35 is always supplied with the drive voltage V2 and selectively supplied with the drive voltages V0 and V3 in response to the level of the CFB signal. It is also apparent from FIG. 5 that the multiplexer 35 employs the drive voltages V2, V3, and V0 as an intermediate voltage, a low voltage, and a high voltage, respectively, when the LCD panel 2 is driven in an alternating fashion.

As illustrated in FIG. 5, at the time when the common-side analog multiplexer 35 is supplied with the CDB1 or CDB2 signal from the flip-flops FF1 to FF220 of the common-side drive circuit 34, it applies the drive voltage V0 or V3 as a common drive signal to the scanning lines X1 to X220 corresponding to the CDB1 or CDB2 signal during a period of time in which the CDB1 or CDB2 signal, i.e., the common drive timing signal is supplied to the scanning lines X1 to X220. At the other time, the multiplexer 35 supplies the drive voltage V2 to the scanning lines X1 to X220.

As described above, the CDB1 signal has a pulse width for selecting two scanning lines, and is shifted through the flip-flops FF1 to FF200 one by one and input to the common-side analog multiplexer 35. Thus, as shown in FIG. 5, the multiplexer 35 applies the same drive voltage V0 or V3 to the adjacent two of the scanning lines X1 to X200, and scans them in sequence.

Since the drive voltage supplied to the multiplexer 35 is switched to the drive voltage V0 or V3 every line in response to the CFB signal, the drive voltage V0 is applied to one of the adjacent two scanning lines and the drive voltage V3 is applied to the other of the adjacent two scanning lines, though the adjacent two scanning lines are scanned at a time.

Consequently, the common-side analog multiplexer 35 sequentially selects and drives the scanning lines X1 to X200 two by two, and alternately selects the drive voltages V0 and V3 every scan (1H).

As described above, the CDB2 signal has a pulse with for selecting one scanning line, and is shifted through the flip-flops FF201 to FF220 one by one and input to the multiplexer 35. Therefore, as shown in FIG.5, the multiplexer 35 selects and drives the scanning lines X201 to X220 one by one.

Since the drive voltage supplied to the common-side analog multiplexer 35 is switched to the drive voltage V0 or V3 every line in response to the CFB signal, the multiplexer 35 alternately applies the drive voltages V0 and V3 to each of the lines.

Consequently, the multiplexer 35 selects and drives the scanning lines X201 to X220 one by one, and alternately selects the drive voltages V0 and V3 every scan.

An operation of the liquid crystal display device according to the first embodiment will now be described.

The LCD device 1 includes the LCD panel 2 which is conceptually divided into two areas (2α and 1α drive areas) 21 and 22 by the direction of scanning lines. In the 2α drive area 21, the scanning lines are driven simultaneously two by two and, in the 1α drive area 22, the scanning lines are driven one by one.

More specifically, the segment-side drive circuit 42 sequentially receives digital display data of plural bits from the control circuit 6 based on the display control signal from the control circuit 6. After the segment-side drive circuit 42 receives the display data of one line, it generates a gradation signal corresponding to the display data and supplies it to the segment-side analog multiplexer 41.

The multiplexer 41 selects one of the drive voltages V0, V1 and V4 input from the power supply 5, in response to the gradation signal generated from the segment-side drive circuit 42, in synchronization with a display control signal input from the control circuit 6, and supplies the selected voltage to each segment line of the LCD panel 2 as a segment drive signal.

In the common-side drive circuit 34, the flip-flop FF1 receives the CDB1 signal, which is input through the inverter In1 and flip-flop FFA1, in synchronization with the rise of the CNB signal, and transmits it to the succeeding flip-flop FF2 and to the common-side analog multiplexer 35.

The flip-flop FF2 receives the CDB1 signal, which is supplied from the flip-flop FF1 in synchronization with the CNB signal, and transmits it to the flip-flop FF3 and to the common-side analog multiplexer 35.

The above operation is sequentially performed with reference to the flip-flop FF1 to flip-flop FF200, and these flip-flops output common drive timing signals based on the CDB1 signal to the common-side analog multiplexer 35.

As shown in FIG. 5, the CDB1 signal has a width for two horizontal scans (2H) of scanning lines, and is sequentially shifted through the flip-flop FF1 to FF200 one by one in response to the CNB signal.

The common-side analog multiplexer 35 supplies the drive voltage V0 or V3, as a common drive signal, to the scanning lines X1 to X200 corresponding to the flip-flops FF1 to FF200 to which the CDB1 signal is input, whereas it supplies the drive voltage V2, as a reference intermediate voltage, to the scanning lines X1 to X200 corresponding to the flip-flops FF1 to FF200 to which no CDB1 signal is input.

In the first display area 21 including the scanning lines X1 to X200, two of these scanning lines are selected and driven at a time and the selected two scanning lines are shifted one by one and, in other words, a so-called 2α drive is executed.

If the liquid crystal display device of the first embodiment is applied to a television receiver, data can be displayed in the first display area 21 in the duty ratio of 1/100, and normal gradation display animation data can be displayed with a sharp contrast.

Since, furthermore, the drive voltages V0 and V3 applied to the common-side analog multiplexer 35 are switched to each other for every scanning line in response to the CFB signal, the drive voltage applied to each of the scanning lines X1 to X200 is also switched to the drive voltage V0 or V3, and these scanning lines can be driven in an alternating fashion.

The liquid crystal of the LCD panel 2 can thus be prevented from deteriorating, and data can be displayed satisfactorily on the LCD panel.

In the common-side drive circuit 34, the flip-flop FF201 receives the CDB2 signal, which is input through the inverter In1 and flip-flop FFA2, in synchronization with the rise of the CNB signal, and transmits it to the succeeding flip-flop FF202 and to the common-side analog multiplexer 35.

The flip-flop FF202 receives the CDB2 signal, which is input from the flip-flop FF201 in synchronization with the CNB signal, and transmits it to the flip-flop FF203 and to the common-side analog multiplexer 35.

The above operation is sequentially performed from the flip-flop FF201 to flip-flop FF220, and these flip-flops FF201 to FF220 output the common drive timing signals based on the CDB signal to the common-side analog multiplexer 35.

As shown in FIG. 5, the CDB2 signal has a width for one horizontal scanning line (1H), and is sequentially shifted through the flip-flop FF201 to FF220 one by one in response to the CNB signal.

The common-side analog multiplexer 35 supplies the drive voltage V0 or V3, as a common drive signal, to the scanning lines X201 to X220 corresponding to the flip-flops FF201 to FF220 to which the CDB2 signal is input, whereas it supplies the drive voltage V2, as a reference drive voltage, to the scanning lines corresponding to the flip-flops to which no CDB1 signal is input.

In the second display area 22 including the scanning lines X201 to X220, these scanning lines are selected and driven one by one and the scanning lines are shifted one by one and, in other words, a so-called 1α drive is executed.

If the liquid crystal display device of the first embodiment is applied to a television receiver, data can be displayed in the second display area 22 in the duty ratio of 1/20, and data such as characters can be clearly displayed without causing a blur. Therefore, the outlines of subtitles of foreign films, letters and characters of video game software and the like can be emphasized, and these characters can thus be easy to read.

In the above first embodiment, the liquid crystal display device is applied to a television receiver; however, the present invention is not limited to this.

(Second Embodiment)

Figure 6:
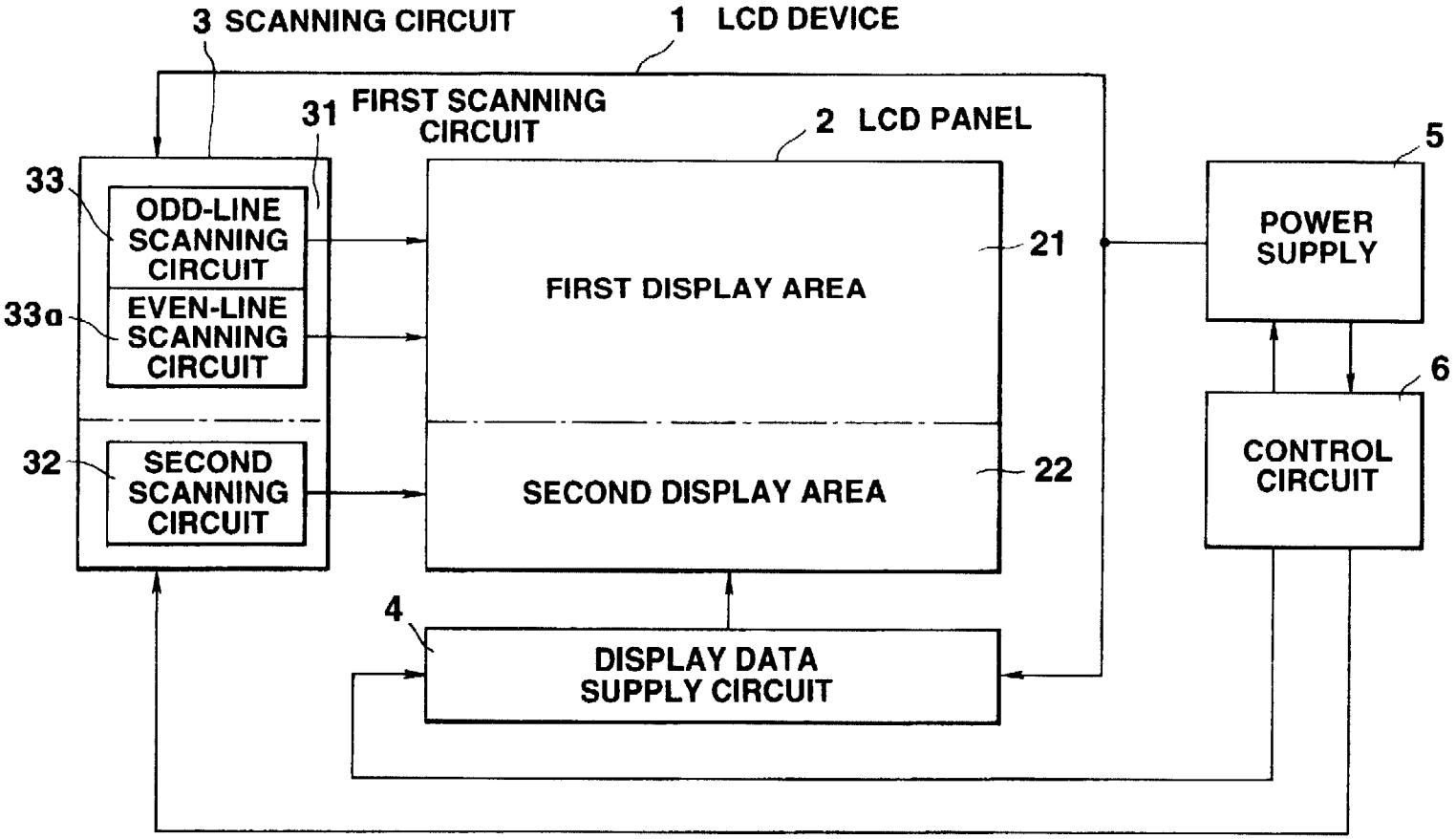
FIG. 6 is a block diagram showing a circuit arrangement of a liquid crystal display device according to a second embodiment of the present invention.

A liquid crystal display device according to a second embodiment of the present invention will now be described. FIG. 6 is a block diagram showing a circuit arrangement of the liquid crystal display device. In FIG. 6, the same constituents as those of FIGS. 1 and 2 are denoted by the same reference numerals, and their descriptions are omitted.

As shown in FIG. 6, the first scanning circuit 31 includes an odd-line scanning circuit 33 and an even-line scanning circuit 33*a*. While the circuit 33 scans odd-numbered scanning lines of the first display area 21, the circuit 33*a* does even-numbered scanning lines thereof.

The timing chart of the liquid crystal display device according to the second embodiment of the present invention, will be described with reference to FIG. 9.

Figure 9:
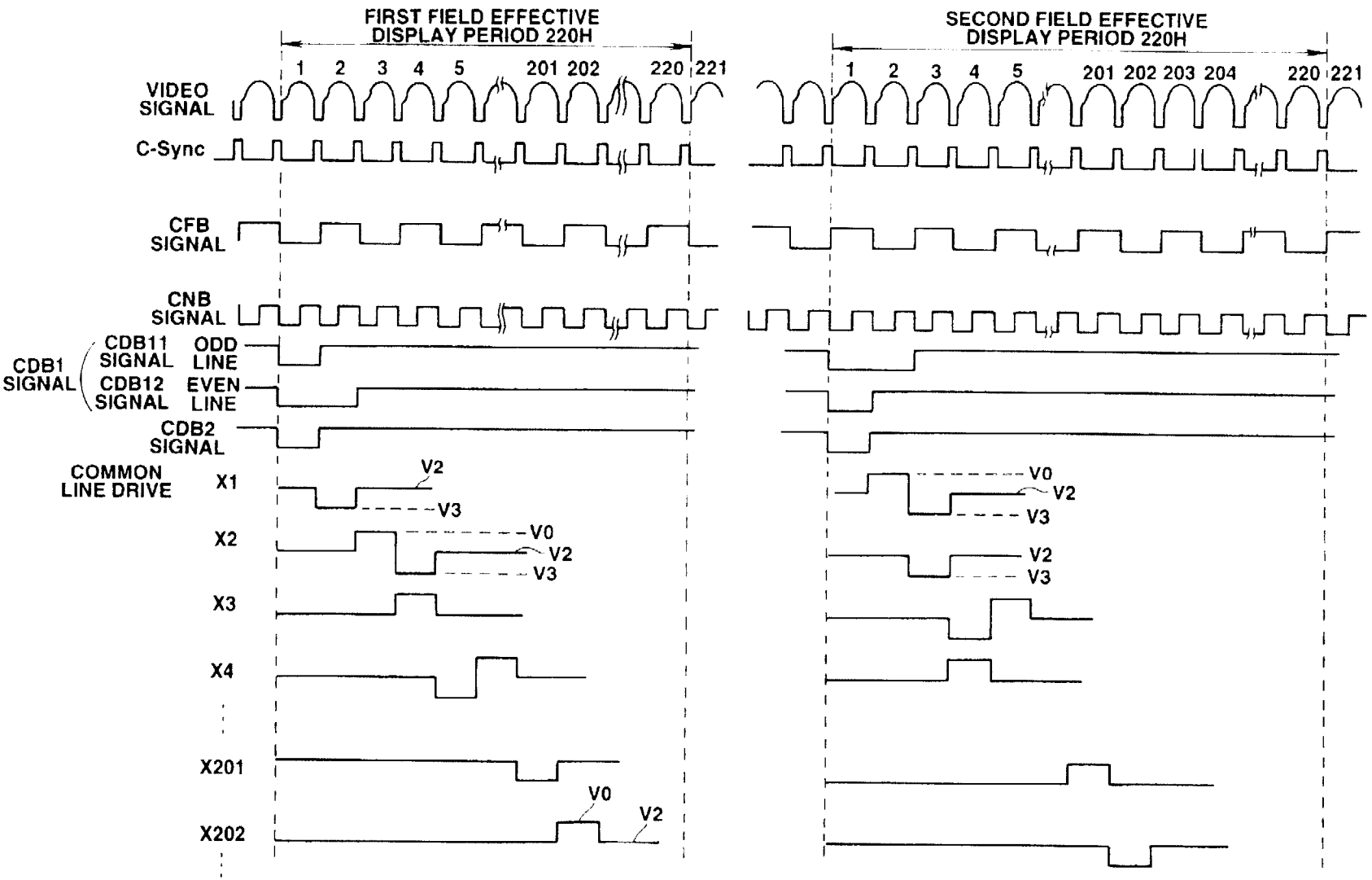
FIG. 9 is a timing chart of the liquid crystal display device according to the second embodiment of the present invention.

In FIG. 9, a video signal is composed of a luminance signal, a color signal and a sync signal, and a first field and a second field constitute one frame. The number of scanning lines of the LCD panel 2 is 220. These scanning lines include scanning lines X1 to X200 of the first display area 21 and scanning lines X201 to X220 of the second display area 22.

In FIG. 9, C-Sync represents a horizontal synchronizing signal extracted from the video signal by the control circuit 6. The control circuit 6 also generates CFB, CNB, CDB1 and CDB2 signals and supplies them to the scanning circuit 3. The CFB signal is a liquid crystal alternating inverting signal for inverting a drive signal for every scanning line, the CNB signal is a transfer signal for sequentially shifting the CDB1 and CDB2 signals in the scanning circuit 3, and the CDB1 and CDB2 signals are signals for determining the scanning start timing of a scanning line and the width thereof.

The CDB1 signal includes a CDB11 signal and a CDB12 signal. The CDB11 signal is a signal for executing a 1α drive for selecting odd-numbered lines one by one from the scanning lines X1 to X200 in the first field and a 2α drive for selecting the odd numbered lines two by two in the second field. The CDB12 signal is a signal for executing a 2α drive for selecting even-numbered lines two by two from the scanning lines X1 to X200 in the first field and a 1α drive for selecting the even-numbered lines one by one in the second field.

The CDB2 signal is a signal for executing a 1α drive for selecting the scanning lines X201 to X220 one by one in both the first and second fields.

The voltages V0 and V3 are alternatively supplied to the scanning lines of the first and second display areas 21 and 22 for the 1α drive and these voltages are inverted for each scanning line and each field. The voltage V2 is applied to each of the non-selected scanning lines.

In the first display area 21, for the 2α drive, the voltage V0 is applied to one of selected two scanning lines and the voltage V3 is applied to the other of the selected two scanning line, and the voltages V0 and V3 are inverted for each scanning line and for each field. The voltage V2 is applied to each of the non-selected scanning lines.

Fig. 8 shows scan drive methods of the liquid crystal display device according to the second embodiment.

As described above, since the 1α and 2α drive signals are alternately applied to the odd- and even-numbered lines in the first display area 21 in the first and second fields, an image having an intermediate characteristic between an image with good contrast formed by the 2α drive and an image with a clear outline formed by the 1α drive can be displayed. Furthermore, since the 1α drive is executed in the second display area 22 in both the first and second fields, a clear character image can be displayed.

(Third Embodiment)

Figure 7:
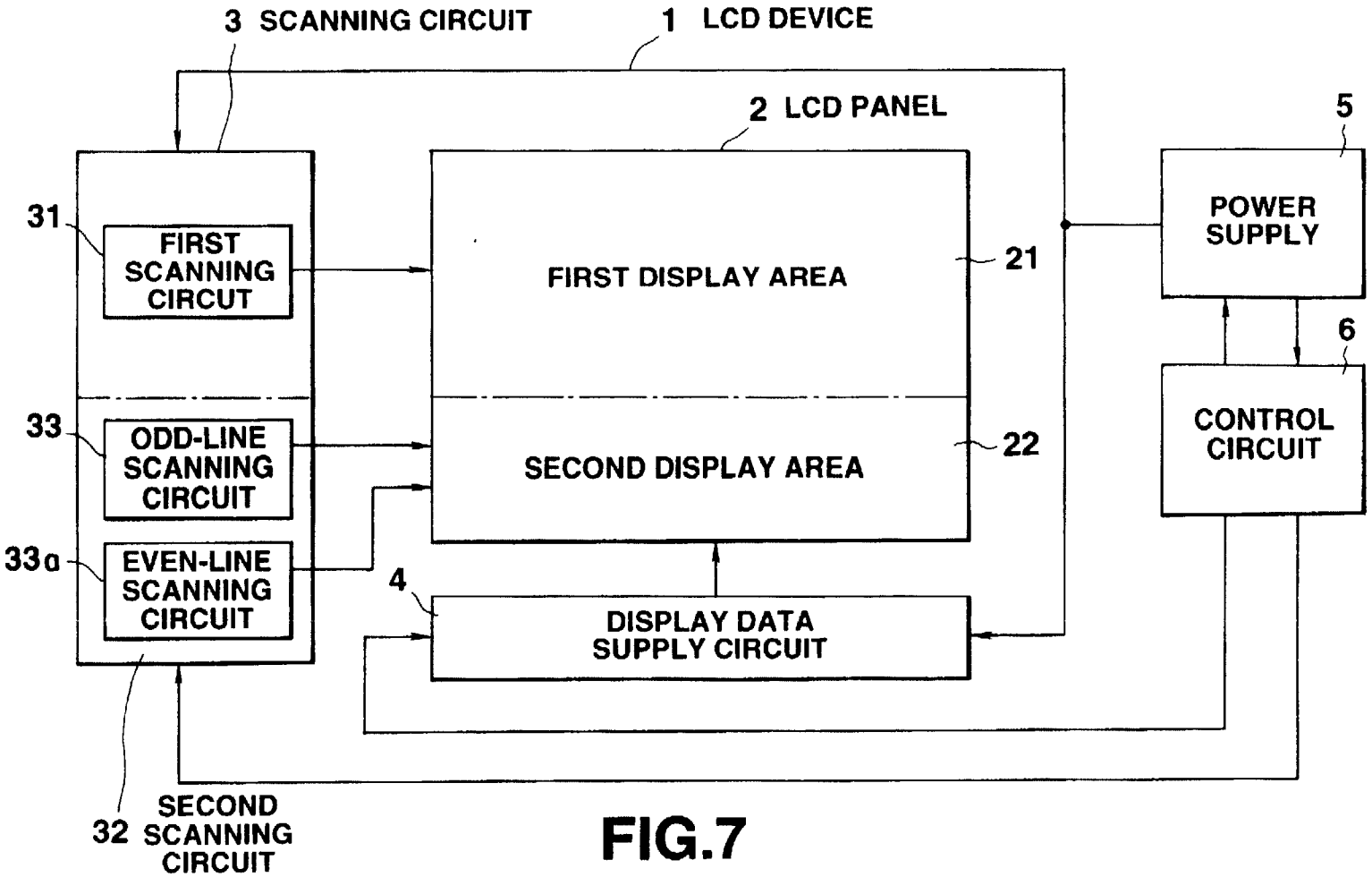
FIG. 7 is a block diagram showing a circuit arrangement of a liquid crystal display device according to a third embodiment of the present invention.

A liquid crystal display device according to a third embodiment of the present invention will now be described. FIG. 7 is a block diagram showing a circuit arrangement of the liquid crystal display device. In FIG. 7, the same constituents as those of FIGS. 1 and 2 are denoted by the same reference numerals, and their descriptions are omitted.

As shown in FIG. 7, the second scanning circuit 32 includes the odd-line scanning circuit 33 and the even-line scanning circuit 34. While the circuit 33 scans odd-numbered scanning lines of the second display area 22, the circuit 34 does even-numbered scanning lines thereof.

Figure 11:
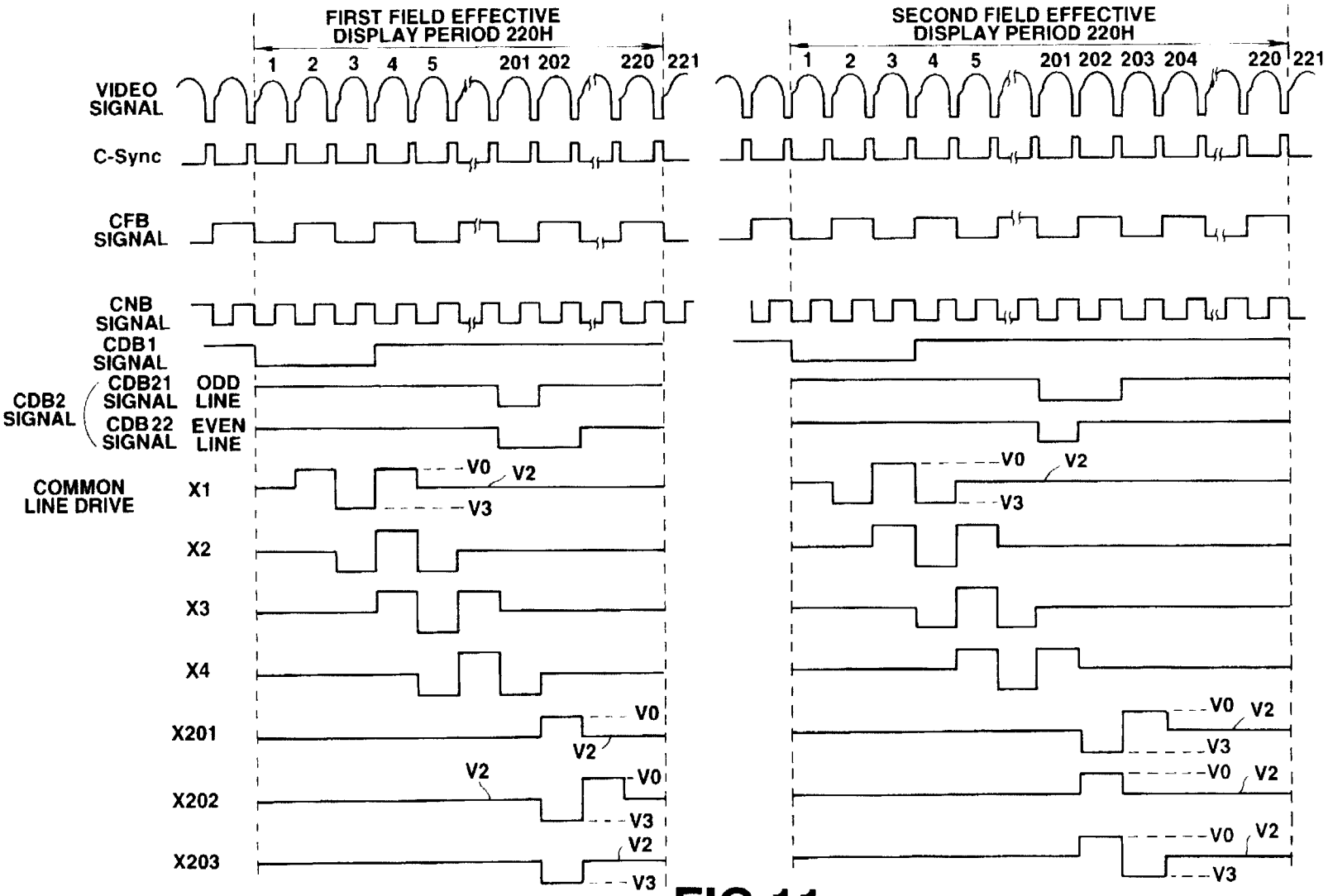
FIG. 11 is a timing chart of the liquid crystal display device according to the third embodiment of the present invention.

The timing chart of the liquid crystal display device according to the third embodiment of the present invention, will be described with reference to FIG. 11.

The video signal, C-Sync signal, CFB signal, CNB signal and CDB signal of the third embodiment are the same as those of the second embodiment and thus their descriptions are omitted.

A CDB1 signal is a signal for executing a 3α drive for selecting the scanning lines X1 to X200 three by three in both the first and second fields. A CDB21 signal is a signal for executing a 1α drive for selecting odd-numbered lines one by one from the scanning lines X201 to X220 in the first field and a 2α drive for selecting the odd-numbered lines two by two in the second field. The CDB22 signal is a signal for executing a 2α drive for selecting even-numbered lines two by two from the scanning lines X201 to X220 in the first field and a 1α drive for selecting the even-numbered lines one by one in the second field.

The voltages V0 and V3 are alternatively supplied to the scanning lines of the first display area 21 for the 3α drive and these voltages are inverted for each scanning line and each field. The voltage V2 is applied to each of the non-selected scanning lines.

The voltages V0 and V3 are alternatively supplied to the scanning lines of the second display area 22 for the 1α drive and these voltages are inverted for each scanning line and each field. The voltage V2 is applied to each of the non-selected scanning lines.

In the second display area 22, for the 2α drive, the voltage V0 is applied to one of selected two scanning lines and the voltage V3 is applied to the other of the selected two scanning line, and the voltages V0 and V3 are inverted for each scanning line and for each field. The voltage V2 is applied to each of the non-selected scanning lines.

Fig. 10 shows scan drive methods of the liquid crystal display device according to the third embodiment.

As described above, since the 3α drive is executed in the first display area 21 in both the first and second fields, an image of good contrast can be displayed. Furthermore, since the 1α and 2α drives are alternately applied to the odd- and even-numbered lines in the second display area 22 in the first and second fields, an image having an intermediate characteristic between an image with a clear outline formed by the 1α drive and an image with good contrast formed by the 2α drive can be displayed.

(Fourth Embodiment)

Figure 12:
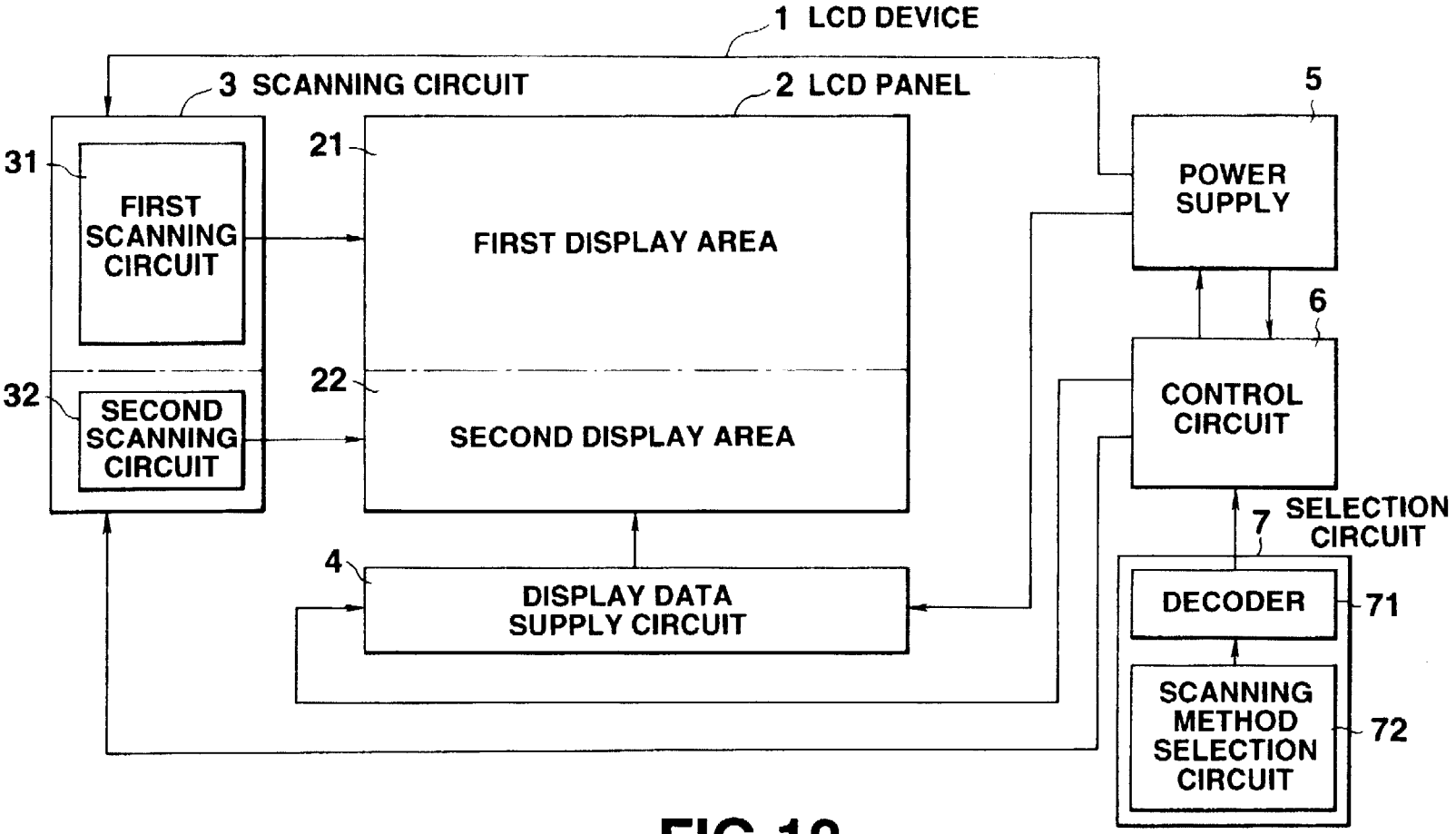
FIG. 12 is a block diagram showing a circuit arrangement of a liquid crystal display device according to a fourth embodiment of the present invention.

A liquid crystal display device according to a fourth embodiment of the present invention will now be described. FIG. 12 is a block diagram showing a circuit arrangement of the liquid crystal display device. In FIG. 12, the same constituents as those of FIGS. 1 and 2 are denoted by the same reference numerals, and their descriptions are omitted.

As shown in FIG. 12, the liquid crystal display device comprises the LCD display 1 for displaying an image of a television receiver, LCD panel 2, scanning circuit 3, display data supply circuit 4, power supply 5, control circuit 6, and selection circuit 7.

The selection circuit 7 includes a decoder 71 and a scanning method selection circuit 72, and is designed to select a desired combination from the scanning methods of 1α or 2α drive for each of first and second display areas 21 and 22.

As illustrated in FIG. 13, the scanning method selection circuit 72 includes a circuit for selecting the 1α or 2α drive for each of the first and second display areas 21 and 22. The scanning method selected by the circuit 72 is represented as a selected binary drive code signal. The selected binary drive code signal is output to the decoder 71 on the next stage. The decoder 71 is a code conversion circuit having a ROM. The selected binary drive code signal, whose code is converted by the decoder 71, is output to the control circuit 6 on the next stage.

Upon receiving the selected binary drive code signal, as shown in FIG. 4, the control circuit 6 causes a short circuit between a POUT terminal from which a signal of the final flip-flop FF200 in the first display area of the scanning circuit 3 is externally output and an input terminal CDB2 to which a CDB2 signal is input, thereby allowing the 2α drive to be executed in all the areas of the LCD panel 2.

In response to the binary drive code signal selected by the selection circuit 7, the control circuit 6 connects the POUT terminal of the scanning circuit 3 to the input terminal CDB2 for the CDB2 signal and inputs the CDB1 signal to the input terminal CDB1. By connecting/disconnecting the POUT terminal to/from the CDB2 terminal and supplying/cutting off the CDB2 signal, the control circuit 6 selects the drive mode between a first mode in which the first area is driven in the 2α mode and the second area is driven in the 1α mode and a second mode in which the whole LCD panel 2 is driven in the 2α mode.

Similarly, in response to the binary drive code signal selected by the selection circuit 7, the control circuit connects the POUT terminal of the scanning circuit 3 to the input terminal CDB2 for the CDB2 signal and inputs the CDB2 signal to the input terminal CDB1. By connecting/disconnecting the POUT terminal to/from the CDB2 terminal and supplying/cutting off the CDB1 signal to the CDB2 terminal, the control circuit 6 selects the drive mode between a first mode in which the first area is driven in the 2α mode and the second area is driven in the 1α mode and a second mode in which the whole LCD panel 2 is driven in the 1α mode.

Consequently a clear image can be displayed by selecting a scanning method according to the image density of the video signal. If an animation image, such as that of a normal television receiver, is displayed on all over the LCD panel 2, both the first and second display areas 21 and 22 are selected as the 2α drive in order to make a sharp contrast. If a character image or a still image, such as that of a wordprocessor and a personal computer, is displayed on all over the LCD panel 2, both the first and second display areas 21 and 22 are selected as the 1α drive in order to make the outlines of characters clear. Moreover, when an animation image including subtitles, such as that of video game software and foreign films, is displayed, the first display area 21 is selected as the 2α drive and the second display area 22 is selected as the 1α drive. Therefore, an animation image with a sharp contrast can be formed, and the outlines of characters can be clearly displayed.

(Fifth Embodiment)

Figure 14:
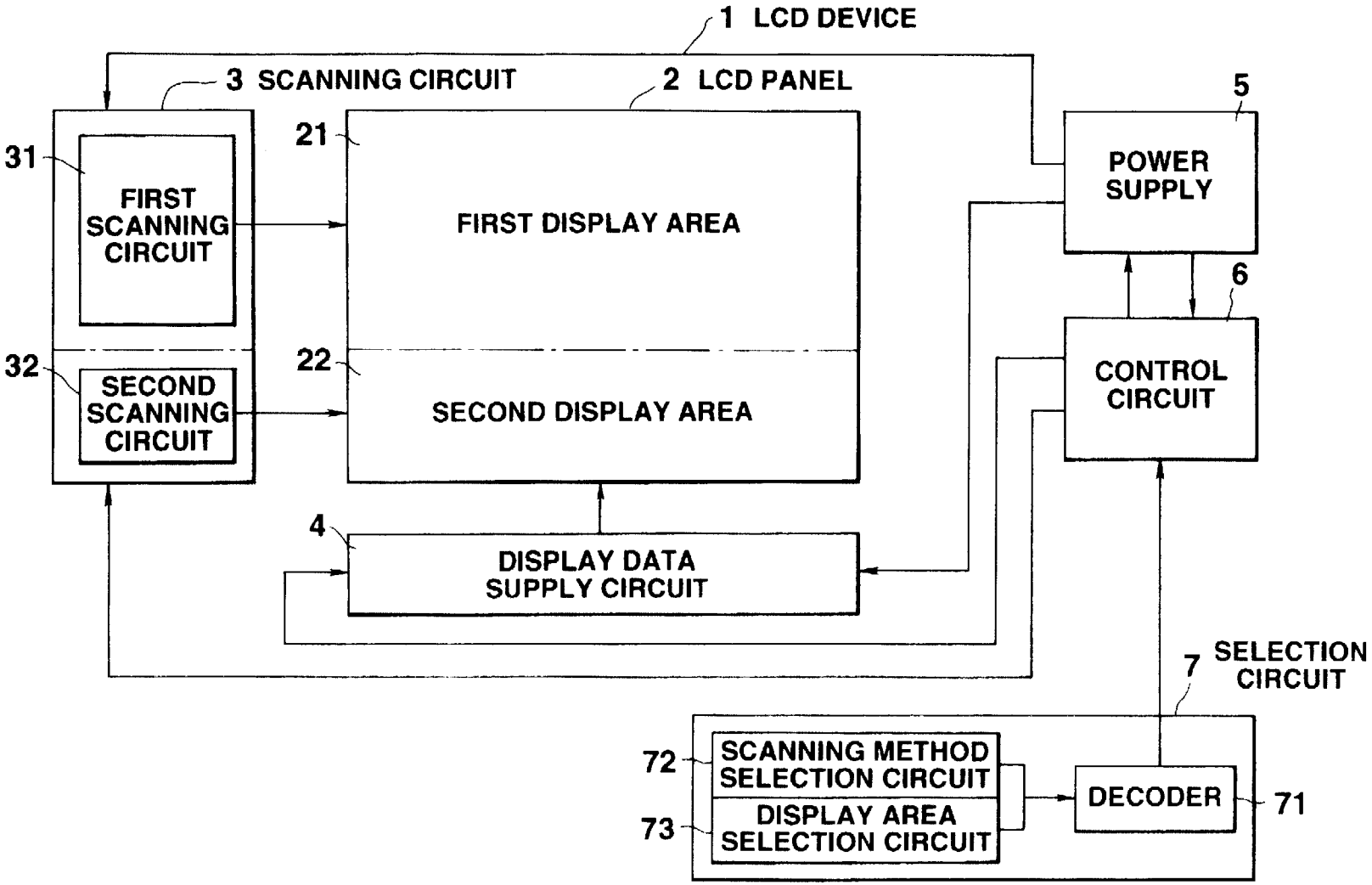
FIG. 14 is a block diagram showing a circuit arrangement of a liquid crystal display device according to a fifth embodiment of the present invention.

A liquid crystal display device according to a fifth embodiment of the present invention will now be described. FIG. 14 is a block diagram showing a circuit arrangement of the liquid crystal display device. In FIG. 14, the same constituents as those of FIGS. 1 and 2 are denoted by the same reference numerals, and their descriptions are omitted.

As shown in FIG. 14, the liquid crystal display device comprises the LCD display 1 for displaying an image of a television receiver, LCD panel 2, scanning circuit 3, display data supply circuit 4, power supply 5, control circuit 6, and selection circuit 7.

The selection circuit 7 includes a decoder 71, a scanning method selection circuit 72, and a display area selection circuit 73. As shown in FIG. 13, the scanning method selection circuit 72 includes a circuit for selecting the 1α or 2α drive for each of the first and second display areas 21 and 22. The scanning method selected by the circuit 72 is represented as a selected binary drive code signal. The display area selection circuit 73 is a circuit for selecting the desired number of scanning lines corresponding to each of the first and second display areas 21 and 22. More specifically, the circuit 73 receives the number n of scanning lines of the first display area 21 by operating a switch or the like from outside and holds the number, while it automatically calculates the number (220–n) of scanning lines of the second display area 22, the number being obtained by subtracting n from the total number (220) of scanning lines. The numbers of scanning lines n and (200–n) of each of the areas 21 and 22 are then supplied to the decoder 71 on the next stage. The decoder 71 is a code conversion circuit having a ROM. The display area set signal, whose code is converted by the decoder 71, is output to the control circuit 6 on the next stage.

The control circuit 6 receives the display area set signal, generates a display control signal, and outputs it to the scanning circuit 3. The scanning circuit 3 includes a first scanning circuit 31 and a second scanning circuit 32. In response to the display control signal, the circuit 31 scans the n scanning lines of the first display area 21 and the circuit 32 does the (220–n) scanning lines of the second display area 22.

The control circuit 6 also receives a selection signal from the scanning method selection circuit 72 through the decoder 71, generates a display control signal, and outputs it to the scanning circuit 3.

In response to the selection signal, as shown in FIG. 4, the control circuit 6 connects the POUT terminal of the scanning circuit 3 to the input terminal CDB2 for the CDB2 signal and inputs the CDB1 signal to the input terminal CDB1. By connecting/disconnecting the POUT terminal to/from the CDB2 terminal and supplying/cutting off the CDB2 signal, the control circuit 6 selects the drive mode between a first mode in which the first area is driven in the 2α mode and the second area is driven in the 1α mode and a second mode in which the whole LCD panel 2 is driven in the 2α mode.

Similarly, in response to the selection signal, the control circuit 6 connects the POUT terminal of the scanning circuit 3 to the input terminal CDB2 for the CDB2 signal and inputs the CDB1 signal to the input terminal CDB1. By connecting/disconnecting the POUT terminal to/from the CDB2 terminal and supplying/cutting off the CDB2 signal, the control circuit 6 selects the drive mode between a first mode in which the first area is driven in the 2α mode and the second area is driven in the 1α mode and a second mode in which the whole LCD panel 2 is driven in the 2α mode.

Further, in response to the selection signal, the control circuit 6 connects the POUT terminal of the scanning circuit 3 to the input terminal CDB2 for the CDB2 signal and inputs the CDB1 signal to the input terminal CDB2. By connecting/disconnecting the POUT terminal to/from the CDB2 terminal and supplying/cutting off the CDB1 signal to the CDB2 terminal, the control circuit 6 selects the drive mode between a first mode in which the first area is driven in the 2α mode and the second area is driven in the 1α mode and a second mode in which the whole LCD panel 2 is driven in the 1α mode.

Consequently, when an animation image is displayed on the first display area 21 and a character image is displayed on the second display area 22, both the images can be clearly displayed by selecting well-balanced display areas in accordance with the sizes of areas for the animation and character images occupied in the LCD panel, and the quality of the displayed images can be improved by selecting a scanning method according to the image density of a video signal. If an animation image, such as that of a normal television receiver, is displayed on all over the LCD panel 2, both the first and second display areas 21 and 22 are selected as the 2α drive in order to make a sharp contrast. If a character image or a still image, such as that of a wordprocessor and a personal computer, is displayed on all over the LCD panel 2, both the first and second display areas 21 and 22 are selected as the 1α drive in order to make the outlines of characters clear. Moreover, when an image including animation and characters together, such as that of video game software and foreign films, is displayed, the first display area 21 is selected as the 2α drive and the second display area 22 is selected as the 1α drive. Therefore, an animation image with a sharp contrast can be formed, and the outlines of characters can be clearly displayed.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A liquid crystal display device for displaying an image of one frame formed of a first field and a second field, the display device comprising:

a liquid crystal display panel including a plurality of scanning lines and a plurality of segment lines formed in a matrix, and having a first display area with a first number of scanning lines and a second display area with a second number of scanning lines which is smaller than the first number of scanning lines;

display data supply means for supplying a segment drive signal corresponding to display data to the segment lines of said liquid crystal display panel;

first scanning means for supplying to the first display area a first scanning signal for simultaneously scanning at least two scanning lines during one scanning line period such that at least one scanning line is shifted to a next scanning line period; and second scanning means for, after the first number of scanning lines in the first display area are scanned, supplying to the second display area a second scanning signal for scanning at least one scanning line during one scanning line period such that at least one scanning line is shifted to a next scanning line period, the second scanning signal having a selection period other than a selection period of the first scanning signal output from said first scanning means.

2. The device according to claim 1, wherein said first scanning means supplies the first scanning signal having a selection period of at least two horizontal scanning lines to one scanning line, and said second scanning means supplies the second scanning signal having a selection period of at least one horizontal scanning line to one scanning line.

3. The device according to claim 2, wherein said plurality of scanning lines are scanned in sequence, in response to the first and second scanning signals output from said first and second scanning means, while the selection period of said at least one horizontal scanning line is shifted every scanning of at least one of the scanning lines.

4. The device according to claim 2, wherein the first and second scanning signals output from said first and second scanning means have polarities which are inverted for each of the first and second fields.

5. The device according to claim 1, wherein said first scanning means supplies the first scanning signal to the first display area in the first field, and supplies a third scanning signal thereto in the second field, the third scanning signal having a selection period of at least one scanning line other than the selection period of the first scanning signal.

6. The device according to claim 1, wherein said first scanning means comprises odd-numbered line scanning means for scanning odd-numbered scanning lines of the first display area and even-numbered line scanning means for scanning even-numbered scanning lines of the first display area, said odd-numbered line scanning means supplies the first scanning signal to the odd-numbered scanning lines of the first display area, and said even-numbered line scanning means supplies a third scanning signal to the even-numbered scanning lines of the first display area, the third scanning signal having a selection period of at least one scanning line other than the selection period of the first scanning signal.

7. The device according to claim 6, wherein said odd-numbered line scanning means outputs the third scanning signal in the first field and the first scanning signal in the second field, and said even-numbered line scanning means outputs, the first scanning signal in the first field and the third scanning signal in the second field.

8. The device according to claim 1, wherein said second scanning means supplies the second scanning signal to the second display area in the first field and supplies a fourth scanning signal thereto in the second field, the fourth scanning signal having a selection period of at least one horizontal scanning line other than the selection period of the second scanning signal.

9. The device according to claim 1, wherein said second scanning means comprises odd-numbered line scanning means for scanning odd-numbered scanning lines of the second display area and even-numbered line scanning means for scanning even-numbered scanning lines of the second display area, said odd-numbered line scanning means supplies the second scanning signal to the odd-numbered scanning lines of the second display area, and said even-numbered line scanning means supplies a fourth scanning signal to the even-numbered scanning lines of the second display area, the fourth scanning signal having a selection period of at least one scanning line other than the selection period of the second scanning signal.

10. The device according to claim 9, wherein said odd-numbered line scanning means outputs the second scanning signal in the first field and the fourth scanning signal in the second field, and said even-numbered line scanning means outputs the fourth scanning signal in the first field and the second scanning signal in the second field.

11. The device according to claim 1, wherein said first scanning means supplies a fifth scanning signal having a selection period of three scanning lines in the first and second fields, said second scanning means comprises odd-numbered line scanning means for scanning odd-numbered scanning lines of the second display area and even-numbered line scanning means for scanning even-numbered scanning lines of the second display area, said odd-numbered line scanning means supplies the second scanning signal to the odd-numbered scanning lines of the second display area, and said even-numbered line scanning means supplies a fourth scanning signal to the even-numbered scanning lines of the second display area, the fourth scanning signal having a selection period of at least one scanning line other than the selection period of the second scanning signal.

12. The device according to claim 11, wherein the odd-numbered line scanning means of said second scanning means outputs the second scanning signal in the first field and the fourth scanning signal in the second field, and the even-numbered line scanning means of said second scanning means outputs the fourth scanning signal in the first field and the second scanning signal in the second field.

13. A liquid crystal display device for displaying an image of one frame formed of a first field and a second field, the display device comprising:

a liquid crystal display panel including a plurality of scanning lines and a plurality of segment lines formed in a matrix, and having a first display area and a second display area;

display data supply means for supplying a segment drive signal corresponding to display data to the segment lines of said liquid crystal display panel;

first scanning means for supplying to the first display area a first scanning signal for simultaneously scanning at least two scanning lines during one scanning line period; and second scanning means for supplying to the second display area a second scanning signal for scanning at least one scanning line during one scanning line period, the second scanning signal having a selection period other than a selection period of the first scanning signal output from said first scanning means, wherein said first scanning means supplies the first scanning signal to the first display area in the first field, and supplies a third scanning signal thereto in the second field, the third scanning signal having a selection period of at least one scanning line other than the selection period of the first scanning signal.

14. A liquid crystal display device for displaying an image of one frame formed of a first field and a second field, the display device comprising:

a liquid crystal display panel including a plurality of scanning lines and a plurality of segment lines formed in a matrix, and having a first display area and a second display area;

display data supply means for supplying a segment drive signal corresponding to display data to the segment lines of said liquid crystal display panel;

first scanning means for supplying to the first display area a first scanning signal for simultaneously scanning at least two scanning lines during one scanning line period; and second scanning means for supplying to the second display area a second scanning signal for scanning at least one scanning line during one scanning line period, the second scanning signal having a selection period other than a selection period of the first scanning signal output from said first scanning means, wherein said second scanning means supplies the second scanning signal to the second display area in the first field and supplies a further scanning signal thereto in the second field, the further scanning signal having a selection period of at least one horizontal scanning line other than the selection period of the second scanning signal.

15. A liquid crystal display device for displaying an image of one frame formed of a first field and a second field, the display device comprising:

a liquid crystal display panel including a plurality of scanning lines and a plurality of segment lines formed in a matrix, and having a first display area and a second display area;

display data supply means for supplying a segment drive signal corresponding to display data to the segment lines of said liquid crystal display panel;

first scanning means for supplying to the first display area a first scanning signal for simultaneously scanning at least two scanning lines during one scanning line period; and second scanning means for supplying to the second display area a second scanning signal for scanning at least one scanning line during one scanning line period, the second scanning signal having a selection period other than a selection period of the first scanning signal output from said first scanning means, wherein said second scanning means comprises odd-numbered line scanning means for scanning odd-numbered scanning lines of the second display area and even-numbered line scanning means for scanning even-numbered scanning lines of the second display area, said odd-numbered line scanning means supplies the second scanning signal to the odd-numbered scanning lines of the second display area, and said even-numbered line scanning means supplies a further scanning signal to the even-numbered scanning lines of the second display area, the further scanning signal having a selection period of at least one scanning line other than the selection period of the second scanning signal.

16. The device according to claim 15, wherein said odd-numbered line scanning means outputs the second scanning signal in the first field and the further scanning signal in the second field, and said even-numbered line scanning means outputs the further scanning signal in the first field and the second scanning signal in the second field.

17. A liquid crystal display device for displaying an image of one frame formed of a first field and a second field, the display device comprising:

a liquid crystal display panel including a plurality of scanning lines and a plurality of segment lines formed in a matrix, and having a first display area and a second display area;

display data supply means for supplying a segment drive signal corresponding to display data to the segment lines of said liquid crystal display panel;

first scanning means for supplying to the first display area a first scanning signal for simultaneously scanning at least two scanning lines during one scanning line period; and second scanning means for supplying to the second display area a second scanning signal for scanning at least one scanning line during one scanning line period, the second scanning signal having a selection period other than a selection period of the first scanning signal output from said first scanning means, wherein said first scanning means supplies another scanning signal having a selection period of three scanning lines in the first and second fields, said second scanning means comprises odd-numbered line scanning means for scanning odd-numbered scanning lines of the second display area and even-numbered line scanning means for scanning even-numbered scanning lines of the second display area, said odd-numbered line scanning means supplies the second scanning signal to the odd-numbered scanning lines of the second display area, and said even-numbered line scanning means supplies a further scanning signal to the even-numbered scanning lines of the second display area, the further scanning signal having a selection period of at least one scanning line other than the selection period of the second scanning signal.

18. The device according to claim 17, wherein the odd-numbered line scanning means of said second scanning means outputs the second scanning signal in the first field and the further scanning signal in the second field, and the even-numbered line scanning means of said second scanning means outputs the further scanning signal in the first field and the second scanning signal in the second field.

* * * * *